US005141700A

United States Patent [19]

Sze

[11] Patent Number: 5,141,700

[45] Date of Patent: * Aug. 25, 1992

[54] MELT SPINNING PROCESS FOR POLYAMIDE INDUSTRIAL FILAMENTS

[75] Inventor: Benjamin C. Sze, Wilmington, Del.

[73] Assignee: E. I. Du Pont de Nemours and Company, Wilmington, Del.

[ * ] Notice: The portion of the term of this patent subsequent to Jul. 23, 2008 has been disclaimed.

[21] Appl. No.: 664,534

[22] Filed: Mar. 4, 1991

Related U.S. Application Data

[63] Continuation-in-part of Ser. No. 857,289, Apr. 30, 1986, Pat. No. 5,034,182.

[51] Int. Cl.[5] ..... D01D 5/084; D01D 5/098

[52] U.S. Cl. ..... 264/555; 264/210.2; 264/210.8; 264/211.14; 425/72.2

[58] Field of Search ..... 264/555, 210.2, 210.8, 264/211.14; 425/72.2

[56] References Cited

U.S. PATENT DOCUMENTS

| | | | |
|---|---|---|---|
| 2,252,634 | 8/1941 | Babcock | 18/8 |
| 2,604,667 | 7/1952 | Hebeler | 18/54 |
| 2,847,704 | 8/1958 | Scheers | 18/8 |
| 2,957,747 | 10/1960 | Bowlns | 18/54 |
| 3,091,015 | 5/1963 | Zimmerman | 28/72 |
| 3,257,487 | 6/1966 | Dulin, Jr. | 264/176 |
| 3,271,818 | 9/1966 | Bryan | 18/8 |
| 3,313,001 | 4/1967 | Finzel et al. | 18/8 |
| 3,707,593 | 12/1972 | Fukada et al. | 264/210 F |
| 3,929,542 | 12/1975 | Gehrig et al. | 156/167 |
| 3,954,361 | 5/1976 | Page | 425/72 S |
| 4,134,882 | 1/1979 | Frankfort et al. | 528/309 |
| 4,156,071 | 5/1979 | Knox | 528/272 |
| 4,195,051 | 3/1980 | Frankfort et al. | 264/176 F |
| 4,195,052 | 3/1980 | Davis et al. | 264/210.5 |
| 4,288,207 | 9/1981 | Wilkes | 425/72 S |
| 4,402,900 | 9/1983 | Berry, Jr. | 264/205 |
| 4,415,726 | 11/1983 | Tanji et al. | 528/272 |
| 4,425,293 | 1/1984 | Vassilatos | 264/176 F |
| 4,627,811 | 12/1986 | Greiser et al. | 425/72 S |
| 4,681,522 | 7/1987 | Lenk | 425/72 S |
| 4,692,106 | 9/1981 | Grabowski et al. | 425/66 |
| 5,034,182 | 7/1991 | Sze et al. | 264/555 |

FOREIGN PATENT DOCUMENTS

| | | |
|---|---|---|
| 48-43563 | 12/1973 | Japan . |
| 56-13806 | 3/1981 | Japan . |
| 60-134015A | 7/1985 | Japan . |
| 627194 | 9/1978 | U.S.S.R. . |
| 1220424 | 1/1971 | United Kingdom . |

OTHER PUBLICATIONS

Research Disclosure No. 10418, Dec. 1972, "Improved Dry-Spinning Apparatus".

Fiber World Sep. 1984, pp. 8-12 "Physical Limits of Spinning Speed", Ziabicki, Andrzej.

*Primary Examiner*—Hubert C. Lorin

[57] ABSTRACT

An improved melt spinning process for preparing nylon filaments wherein the freshly-extruded filaments enter an enclosed zone that is maintained at superatmospheric pressure by a controlled flow of air at low positive pressure and the filaments leave the zone through a constriction, either a venturi or a tube, assisted by the cocurrent flow of such air at a high controlled velocity.

4 Claims, 4 Drawing Sheets

MELT SPINNING PROCESS FOR POLYAMIDE INDUSTRIAL FILAMENTS

CROSS REFERENCE TO RELATED APPLICATION

This application is a continuation-in-part of U.S. application Ser. No. 06/857,289, filed Apr. 30, 1986, U.S. Pat. No. 5,034,182.

BACKGROUND OF THE INVENTION

This invention concerns an improved process for melt spinning uniform polymeric filaments, especially in the form of heavy denier continuous filament polyamide yarns, by spinning at controlled withdrawal speeds.

There has also been increased interest in improving productivity of heavier denier, e.g. industrial, yarns via increased spinning speeds without sacrificing good yarn properties. Zimmerman in U.S. Pat. No. 3,091,015, which is incorporated herein by reference, discloses a process for spinning high tenacity industrial yarns at speeds of 440 ypm at the first feed roll to produce the desirable low birefringence yarns needed to obtain good mechanical yarn properties after the drawing steps. It would be very desirable from an economic viewpoint to provide an improved process which will remove the spinning speed limitations or raise the plateau which presently exists in the heavy denier industrial yarns without sacrificing good filament properties. However, an article by Professor A. Ziabicki in *Fiber World*, September 1984, pages 8–12, entitled "Physical Limits of Spinning Speed, questions whether higher speeds can yield fibers with better mechanical properties and whether there are any natural limits to spinning speed which cannot be overcome (concentrating on physical and material factors only and excluding economical and technical aspects of the problem). Professor Ziabicki concludes that there exists such a speed beyond which no further improvement of structure and fiber properties is to be expected. In the case of polyester textile filaments, the maxima appear to Professor Ziabicki to be around 5–7 km/min. For industrial yarns, although no such statement was made, no disclosure in the published literature was found which taught how to raise the spinning speed plateau for these yarns without loss of physical properties.

Accordingly, it was very surprising, according to the invention, to provide an improved process for obtaining polymeric filaments and yarns by spinning at significantly higher than conventional spinning speeds with similar or better mechanical properties than has been shown and predicted in the prior art for heavy denier yarns.

SUMMARY OF THE INVENTION

According to the invention, there is provided an improved process for melt spinning uniform polymeric filaments through capillaries in a spinneret in a path to a positive mechanical withdrawal means wherein a cocurrent flow of gas is used to assist the withdrawal of the filaments, the improvement being characterized in that said gas is directed under a controlled positive pressure into an enclosed zone extending from the spinneret to a location between the spinneret and the withdrawal means maintained under superatmospheric pressure and the velocity of the gas is increased to a level greater than the velocity of the filaments as the gas leaves the zone. The enclosed zone is formed from a housing extending from the spinneret on one end to a location between the spinneret and the withdrawal means at its other end. The means for increasing the velocity of the gas as it leaves the zone may be a venturi having a converging inlet and a flared outlet connected by a constriction with the converging inlet being joined to the other end of the housing. As an alternative, the means for increasing the velocity of the gas as it leaves the zone may be a tube joined to the other end of the housing with a continuous wall surrounding the tube to form an annular space surrounding the tube with wall adjoining the housing and means for supplying pressurized gas to the annular space.

An aspirating jet may be used downstream below the means for increasing the velocity of the gas to assist cooling and further reduce aerodynamic drag so as to further reduce spinning tension and increase spinning continuity.

In this manner the process can be used to control yarn morphology, i.e. birefringence, by varying temperature and velocity. Even though the initial spinline velocity of the filaments at the spinneret and the final spinline velocity of the filaments at the withdrawal means remain fixed, using the present invention it is possible to change the spinline velocity profile of the filaments between the spinneret and the positive withdrawal means. The velocity of the gas exiting the enclosed zone increases the velocity of the filaments within the zone to a greater level than the velocity of the filaments leaving the spinneret but less than the velocity of the filaments at the positive mechanical withdrawal means. As a result, the birefringence level of the filaments is reduced.

DETAILED DESCRIPTION OF THE ILLUSTRATED EMBODIMENT

Figure 1:
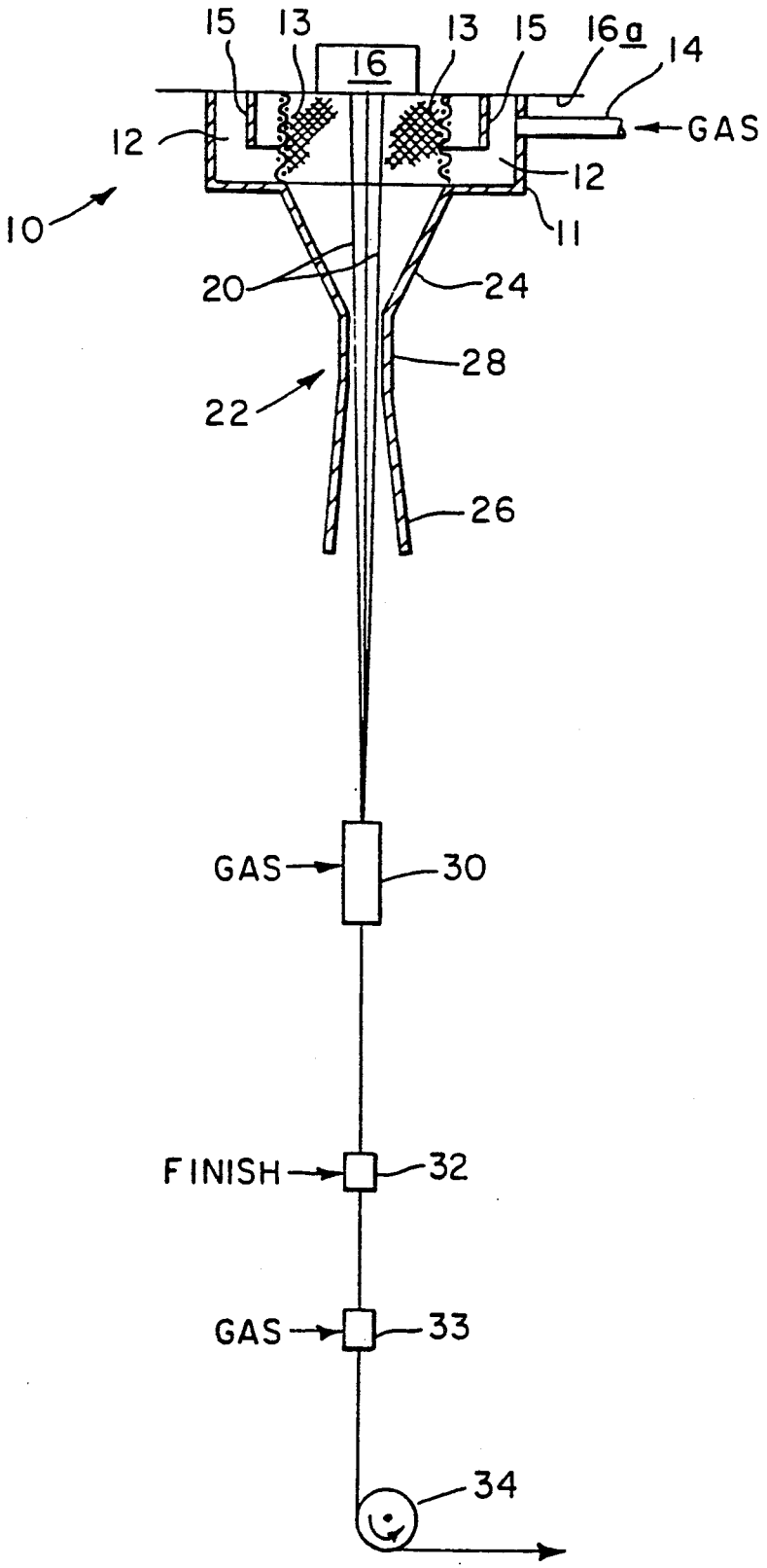
FIG. 1 is a schematic elevation view partially in section of one embodiment of the apparatus for practicing the invention.

Referring to FIG. 1, this embodiment includes a housing 10 which forms a chamber 12, i.e. an enclosed zone supplied with a gas, through inlet conduit 14 which is formed in the side wall 11 of the housing. A circular screen 13 and a circular baffle 15 are concentrically arranged in housing 10 to uniformly distribute the gas flowing into chamber 12. A spinning pack 16 is positioned centrally with and directly above the housing which abuts the surface **16*a* of the pack. A spinneret (not shown) is attached to the bottom surface of the spinning pack for extruding filaments 20 into a path from molten polymer supplied to the pack. A venturi 22 comprising a flared inlet 24 and a flared outlet 26 connected by a constriction 28 is joined at its inlet to housing 10. An aspirating jet 30 located downstream of the venturi 22 is followed by a withdrawl roll 34**.

In operation, a molten polymer is metered into spinning pack 16 and extruded as filaments 20. The filaments are pulled from the spinneret into a path by withdrawal roll 34 assisted by the gas flow through the venturi 22 and the aspirating jet 30.

The terms withdrawal speed and spinning speed, and sometimes winding speed, are used when discussing Frankfort et al. and Tanji to refer to the linear peripheral roll speed of the first driven roll that positively advances the filaments as they are withdrawn from the spinneret. According to the invention, while the air flow through the venturi 22 and through the aspirator 30 is important in assisting withdrawal roll 34 to pull the filaments 20 away from the spinneret, such air flow is not the only force responsible for withdrawal of the filaments. This contrasts with the prior art such as is mentioned above which uses air flow as the only means of withdrawing and drawing filaments from the spinneret. The temperature of the gas in the enclosed zone 12 may be from −20° C. to 250° C. The preferred distance between the face of the spinneret located at the lower surface of spinning pack 16 and the throat or restriction 28 of venturi 22 is from about 6 to 60 inches. The diameter (or equivalent width of the cross-sectional area) of the throat or constriction 28 should preferably be from about 0.25 to 1 inch but this will depend to some extent on the number of filaments in the bundle. If a rectangular slot is used as the throat, the width may be even less, e.g. as little as 0.1 inches. If the width is too small, the filaments may touch each other in the nozzle and fuse. If the diameter of constriction 28 is too large, a correspondingly large amount of gas flow will be required to maintain the desired velocity at the throat and this may cause undesirable turbulence in the zone and so filament instability will result.

The pressure in the housing 10 should be high enough to maintain the desired flow through the venturi 22. Normally it is between about 0.01 kg/cm$^2$ to 0.1 kg/cm$^2$ depending on the dimensions on the filaments being spun, namely the denier, viscosity and speed, but preferably less than 0.03 kg/cm$^2$. As mentioned, a low superatmospheric pressure is important.

The flared outlet of the venturi 26 should preferably be of length between about 1 and 30 inches, depending on the spinning speed. The preferred geometry of the flared outlet 26 is divergent with a small angle, e.g. 1° to 2° and not more than about 10°, so that the converging inlet 24, the constriction 28 and the flared outlet 26 together form a means for increasing the velocity of the gas as it leaves zone 12. The flared outlet 26 allows the high velocity air to decelerate and reach atmospheric pressure at the exit from this outlet without gross eddying, i.e. excessive turbulence. Less divergence, e.g. a constant diameter tube, may also work at some speeds but would require a higher supply pressure to obtain the same gas flow. More divergence leads to excessive turbulence and flow separation.

Filaments emerging from the venturi are allowed to cool in the atmosphere, preferably for a short distance, before entering an aspirating jet 30 placed at a suitable distance downstream of the venturi 22. It is desirable to separate the aspirating jet from the venturi because the amount of air aspirated with the filaments by the aspirating jet may be substantially larger than the amount of air flowing out from the venturi and so to avoid a large mismatch in the flow rates which would lead to turbulence and yarn instability. The function of the aspirating jet is to cool the filaments rapidly to increase their strength and to reduce the increase in spinning tension due to aerodynamic drag.

A finish (anti-stat, lubricant) is applied to the filaments by means of finish applicator 32. This should be downstream of the aspirating jet 30 but ahead of the withdrawal roll 34. An air interlacing jet 33 may be used to provide the filaments with coherence when the object is to prepare a continuous filament yarn. This is located downstream of any finish applicator.

Figure 2:
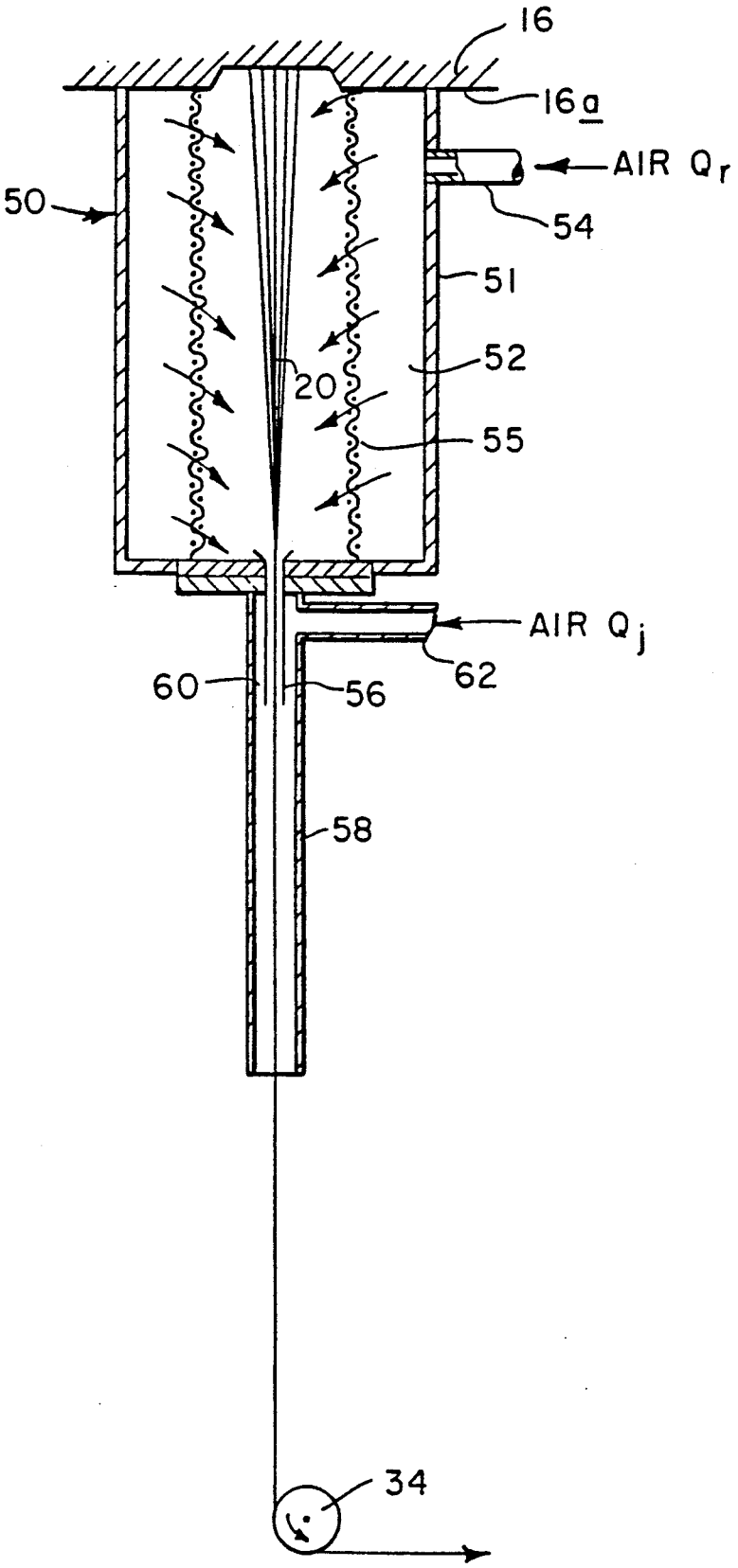
FIG. 2 is a schematic elevation view partially in section of another embodiment of an apparatus for practicing the invention.

In another embodiment of the apparatus shown in FIG. 2, the means for increasing the velocity of the gas includes a housing 50 which forms a chamber 52 supplied with a pressurized gas $Q_r$ through inlet conduit 54 which is formed in the side wall 51 of the housing. A cylindrical screen 55 is positioned in chamber 52 to uniformly distribute gas flowing into the chamber. A spinning pack 16 is positioned centrally with and directly above the housing which abuts and is sealed to the surface **16*a* of the pack. A spinneret (not shown) is attached to the bottom surface of the spinning pack for extruding filaments 20 into a path from molten polymer supplied to the pack. A tube 56 is joined to the housing 50 at the outlet end of the housing in line with the path of the filaments. The top of the tube is slightly flared. A continuous wall or second tube 58 surrounds tube 56 and is spaced therefrom to form an annular space 60 surrounding the tube 56. The wall is joined to the housing 50 at the outlet of the housing. An inlet pipe 62 through the wall 58 provides a means to supply pressurized gas $Q_j$ to space 60. The operation is similar to that described for FIG. 1 except the withdrawal of the filaments is assisted by the gas flow through straight tube 56. The diameters of tubes 56, 58 and the air flow rates $Q_r$ and $Q_j$ are chosen in such a way as to have equal average gas velocity in both tubes. In this manner disturbance of the filaments at the exit of tube 56 into the tube is minimized. Furthermore, the tube 56 should be well centered and the flow $Q_j$ uniformly distributed so that the gas velocity in the annulus 60** between the two tubes is the same at any circumferential position. Also, the velocity of the gas in the annulus should be about two (2) times greater than the common velocity in the two tubes but not significantly greater than that.

Figure 3:
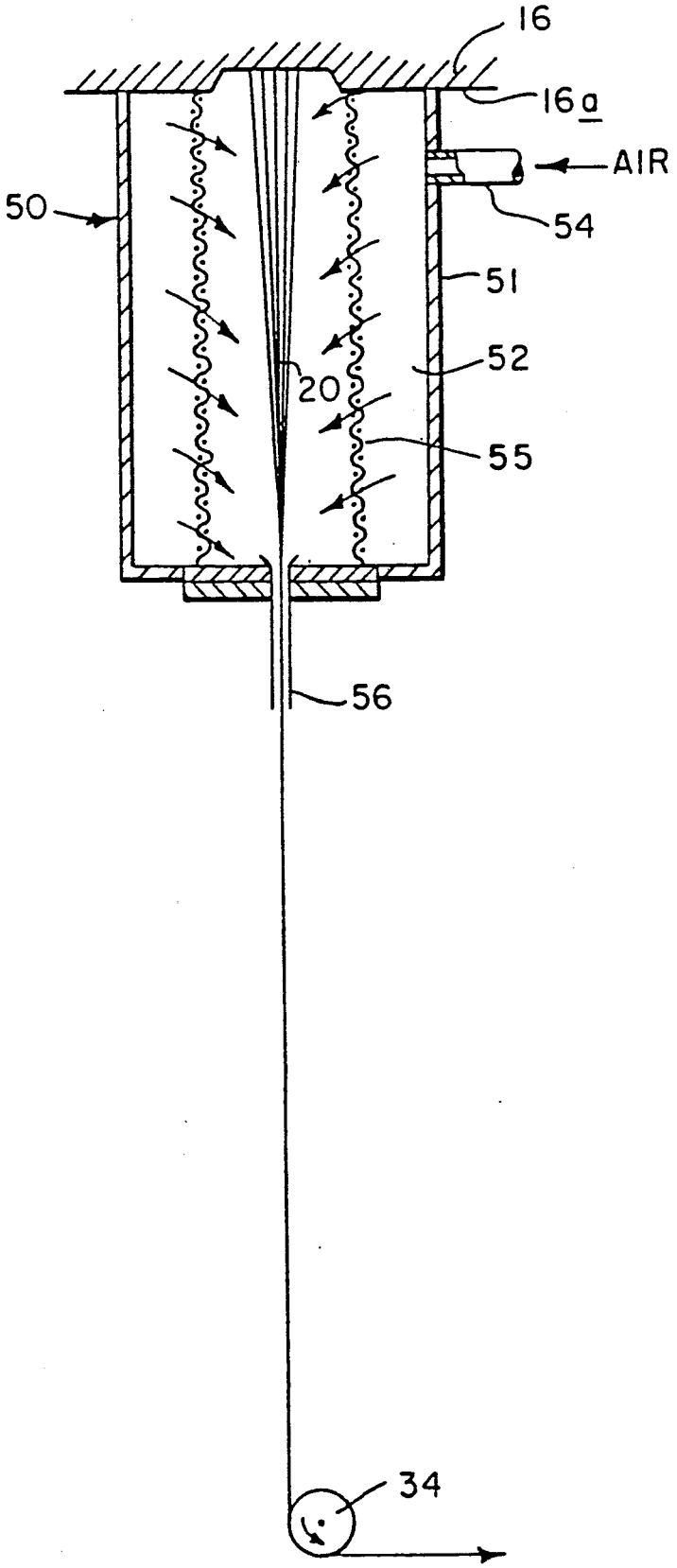
FIG. 3 is a schematic elevation view of still another embodiment of the apparatus for practicing the invention.
Figure 4:
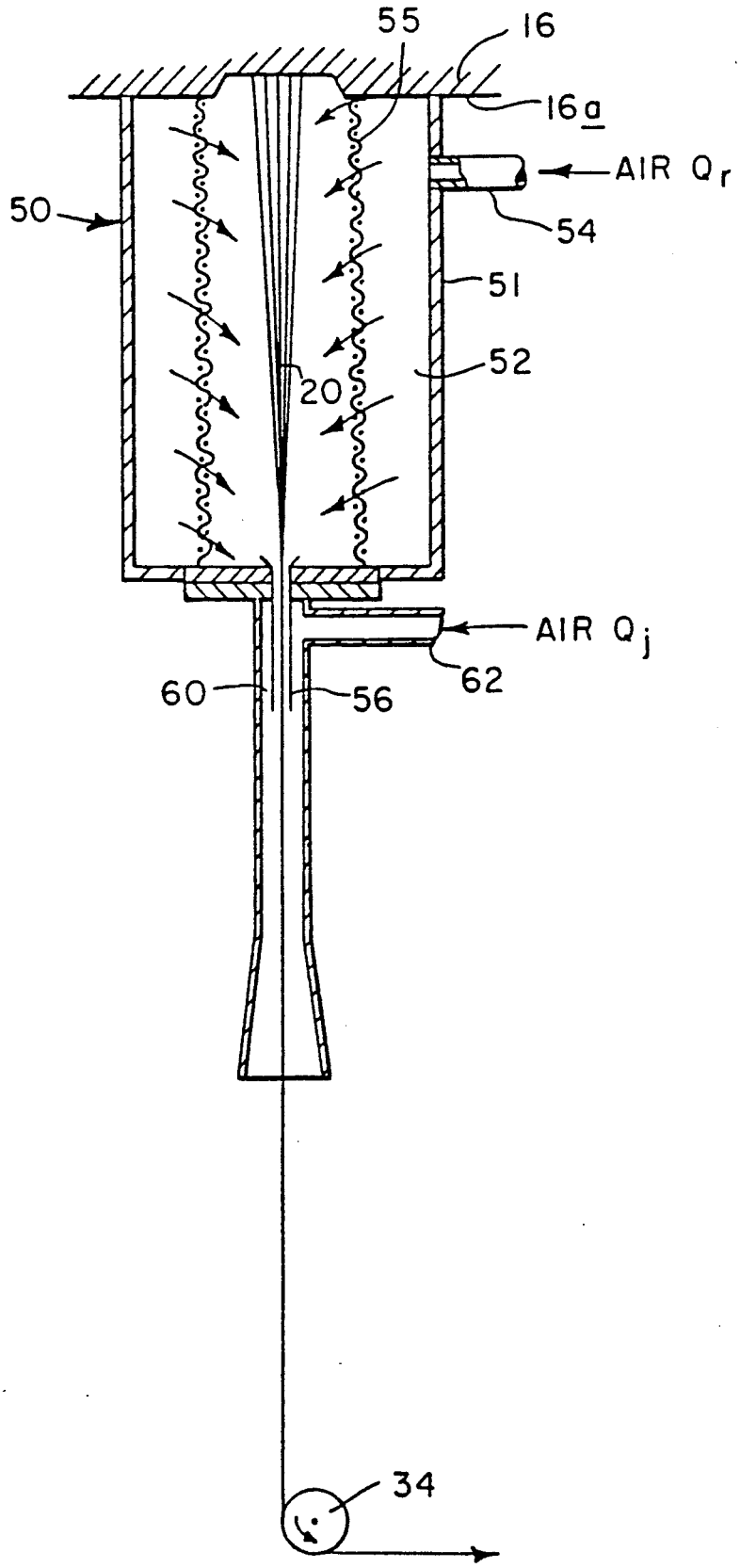
FIG. 4 is a schematic elevation of an improvement made to FIG. 2.

FIGS. 3 and 4 illustrate embodiments similar to FIG. 2. In FIG. 3 the tube 58 is removed. In FIG. 4 the wall of the outer tube 58 has a divergent outlet 64. This minimizes turbulence at the breakup point of the gas stream outside the tube 58.

Test Methods

Tensile Properties:

Packaged yarns were conditioned before testing for at least 2 hours in a 55%±2% relative humidity, 74° F.±2° F. (23° C.±1° C.) atmosphere and measured under similar conditions unless otherwise indicated.

The tensile properties of the yarn were measured on an Instron tensile tester. Sample length of 10 in. (25.4 cm) was clamped between the jaws of the tester. A stress-strain curve was obtained while the yarn sample was being extended at a rate of 12 in./min. (30.5 cm/min.). The yarn tenacity (T) is determined as the load in grams at the point of failure divided by denier of the yarn. Elongation (% E) is the percent increase in length of the sample at the point of failure.

Initial modulus is determined from the slope of a line drawn tangential to the "initial" straightline portion of the stress strain curve. The "initial" straightline portion is defined as the straightline portion starting at 0.5% of full scale load. For example, full scale load is 50.0 pounds for 600–1400 denier yarns, therefore, the "initial" straightline portion of the stress-strain curve would start at 0.25 pound. Full scale load is 100 pounds for 1800–2000 denier yarns and the initial straightline portion of the curve would start at 0.50 pound.

Relative Viscosity:

Relative viscosity refers to the ratio of solution and solvent viscosities measured in a capillary viscometer at 25° C. The solvent is formic acid containing 10% by weight of water. The solution is 8.4% by weight polyamide polymer dissolved in the solvent.

Denier:

Denier or linear density is the weight in grams of 9000 meters of yarn. Denier is measured by forwarding a known length of yarn, usually 45 meters, from a multifilament yarn package to a denier reel and weighing on a balance to an accuracy of 0.001 g. The denier is then calculated from the measured weight of the 45 meter length.

Density:

The density is determined from density gradient tube experiments by the method of ASTM D15056-68.

Birefringence—Senarmont Method:

The Senarmont method entails measuring the phase difference between the two waves associated with a birefringent fiber by polarized light microscopy. The phase difference, converted to a unit of length representing the difference between the faster and slower waves (path difference), divided by the fiber diameter, gives the birefringence. More particularly, a length of yarn is cut obliquely with a fresh razor blade to produce wedge-shaped fiber ends. The fibers are placed in a drop of immersion fluid (e.g. Cargille Immersion Fluid, Type B or equivalent) on a microscope slide and covered with a cover glass. The preparation is placed on a Leitz Orthoplan polarizing microscope (or equivalent) between crossed polars with the polars' transmission directions set to a NS, EW configuration. A Senarmont compensator, a compensator having a phase difference corresponding to $\frac{1}{4}$ wavelength for monochromatic light of 546 nm wavelength, is inserted into the microscope's compensator slot corresponding to the NW-SE direction. The microscope's light source is monochromatized with a 546 nm interference filter. When viewed through the microscope, a birefringent, round fiber will typically appear green with a symmetrical series of dark bands on either side of the fiber center when the fiber attitude is set to 45° relative to the polars' transmission directions. In some cases, e.g. when the birefringence is low, no bands will be seen. A fiber is selected whose cut end (wedge) allows one to easily count the number of dark bands which correspond to integers of path difference in units of the illuminating wavelength. If the fiber has three dark bends on either side of the fiber center, then three bands will be seen in the fiber end. The fiber is centered in the field of view and its attitude set to SW-NE. The microscope's analyzer is rotated in a direction such that the two dark bands closest to the fiber center move towards each other. When the two dark bands have merged (fiber center is darkest), the amount of analyzer rotation in degrees (theta 1) is recorded.

The fiber is rotated 90°and the analyzer rotated in the opposite direction from its original setting until the center again becomes darkest and that rotation is recorded. The sum of the two analyzer rotations can then be used to determine the path difference of the fiber:

$$\text{Path Difference} = N + \frac{\text{Theta 1} + \text{Theta 2}}{360} \times \text{lambda}$$

where N = integers of the wavelength expressed in micrometers and lambda = wavelength.

The path difference divided by the fiber diameter (in micrometers) gives the fiber birefringence. The fiber diameter is measured with an image shearing eyepiece.

Endotherm:

The endotherm (melting point) is determined by the inflection point of a differential scanning calorimeter curve, using a Du Pont model 1090 Differential Scanning Calorimeter operated at a heating rate of 20° C./minute.

EXAMPLE I (6–6) Nylong having a relative viscosity of 70 which is measured in a solution of formic acid was extruded from a spinneret having 10 fine holes of 0.30 mm in diameter and 1.3 mm long on a circumference of a circle of 5 cm in diameter a spinning temperature of 300° C. The extruded filaments were passed through a cylinder as described and a venturi with an air flow of 6 SCFM at 23° C. as shown in FIG. 1. Upon leaving the venturi, the filaments were collected at 1000 m/min by winding on a cylindrical package. Subsequently, orientation of the filaments was determined by optical birefringence. The spun yarn denier was 300 for 10 filaments. Birefringence was 0.012. By comparison filaments spun without using the cylinder and venturi of FIG. 1 had a birefringence of 0.017. The higher value of birefringence limits drawability of the yarn to a lower level of draw ratio which, in turn, produces yarn with a lower level of tensile properties. Alternatively, to produce yarn with a comparable level of properties, the winding speed will have to be reduced from 1000 m/min to about 400 m/min if the apparatus of the subject invention is not used.

What is claimed is:

1. In melt-spinning process for spinning continuous polyamide industrial filaments in a path from a spinning pack at a spinning speed controlled by a positive mechanical withdrawal means that controls the speed of the filaments in the range of from about 440 yds./min. to about 1,000 yds./min. whereby said filaments are oriented to a birefringence level, the improvement for decreasing said birefringence level of the filaments comprising: directing a gas into a zone enclosing said path, said zone extending from said spinning pack to a location between the spinning pack and the positive mechanical withdrawal means; maintaining said zone under superatmospheric pressure of less than 0.03 kg/cm$^2$ and increasing the velocity of the gas as it leaves the zone to a level greater than the velocity of the filaments to reduce the birefringence level of said filaments.

2. The process of claim 1, said polyamide being polyhexamethylene adipamide.

3. The process of claim 1, said polyamide being polycaproamide.

4. The process of claims 1, 2 or 3, said gas being air, the temperature of said gas being from about −20° C. to about 250° C.

* * * * *